US006843077B1

(12) United States Patent
Ishihara et al.

(10) Patent No.: US 6,843,077 B1
(45) Date of Patent: Jan. 18, 2005

(54) KNITTED SURFACE FASTENER

(75) Inventors: Mitsutoshi Ishihara, Toyama-ken (JP); Eiji Nakayama, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/877,431

(22) Filed: Jun. 25, 2004

(30) Foreign Application Priority Data

Jul. 15, 2003 (JP) ..... 2003-274704

(51) Int. Cl.[7] ..... D04B 21/04
(52) U.S. Cl. ..... 66/194
(58) Field of Search ..... 66/191, 192, 193, 66/194, 195, 190; 24/445, 446, 449

(56) References Cited

U.S. PATENT DOCUMENTS 3,603,117 A * 9/1971 Svoboda et al. ..... 66/193
4,709,562 A * 12/1987 Matsuda ..... 66/193
4,838,044 A * 6/1989 Matsuda et al. ..... 66/190
5,125,246 A * 6/1992 Shytles ..... 66/193
5,214,942 A * 6/1993 Peake et al. ..... 66/194
5,267,453 A * 12/1993 Peake et al. ..... 66/194
5,407,722 A * 4/1995 Peake et al. ..... 66/193
5,449,530 A * 9/1995 Peake et al. ..... 427/244
5,664,441 A * 9/1997 Clerici ..... 66/193
6,216,496 B1 * 4/2001 Gehring ..... 66/191
6,705,132 B1 * 3/2004 Hajek ..... 66/194

* cited by examiner

*Primary Examiner*—Danny Worrell
(74) *Attorney, Agent, or Firm*—Michael S. Leonard; Everest Intellectual Property Law Group

(57) ABSTRACT

A knitted surface fastener wherein pile loops are formed by knitting-in pile knitting yarns at the same time when a foundation fabric is knitted with foundation yarns. After the pile knitting yarns which form the pile loops stride between two or more wales to form loops, they are entangled with each stitch of the foundation yarns of three or more adjoining courses on a same wales continuously to form stitches. Of the stitches of the pile knitting yarns formed due to the pile knitting yarns entangled per each of the adjoining three or more courses, at least one or more stitches located in the middle are formed in a closed loop. Consequently, the necessity of back coating is eliminated and further, clearly square gaps are formed to achieve ventilation property and transparency.

7 Claims, 10 Drawing Sheets

0−1/1−0

1−1/0−0/3−3/2−2/3−3/0−0

KNITTED SURFACE FASTENER

BACKGROUND OF THE INVENTION

1. Field of the Invention

The present invention relates to a knitted surface fastener in which pile-like engaging elements are formed of knitting yarns knitted in at the same time when foundation yarns are knitted, and more particularly to a knitted surface fastener which eliminates the necessity of fixing the engaging elements to a foundation structure by fusion bonding the engaging elements and the foundation yarns with various kinds of resin materials and provides a transparent net-like foundation structure.

2. Description of the Related Art

Conventionally, many proposals about manufacturing a surface fastener, in which pile knitting yarns for constituting male or female engaging elements are knitted in at the same time when the foundation yarns are knitted so as to form pile loops, have been provided. As for most structures of these proposed knitted surface fasteners, as disclosed in, for example, U.S. Pat. No. 5,125,246, generally, the foundation yarns are knitted at a high density and at the same time, the pile knitting yarns are knitted in. According to this US patent, elastomer yarns are used for weft in-laid yarns of 0-0/x-x (x: 2, 3, . . . n) and warp in-laid yarns of 0-0/1-1 while wales are knitted with chain knitting yarns, and the pile knitting yarns are entangled obliquely for every adjoining wales and courses based on a tricot knitting structure of 1-2/1-2/0-1/0-1 so as to form pile loops.

If an object to which this knitted surface fastener is to be mounted is an ordinary knitted fabric or woven fabric, there occurs no special problem even in such a high density knitted surface fastener. However, if the aforementioned high density knitted surface fastener is mounted on such an article as clothes or bags formed in a net structure or lace structure having ventilation property, the knitting structure of that mounting portion is hidden. As a result, when a final product is produced, the characteristic as a net product or a lace product can be lost thereby lowering the value as a product.

To obtain a surface fastener provided with the ventilation property, for example, Japanese Utility Model Application Laid-Open No. 63-91009 has proposed that the foundation structure is knitted while forming grid-like or staggered circular through holes with back yarns, middle yarns and front yarns and after pile loops are formed on a face by erecting the front yarns, a face knitted with the back yarns is coated with resin to fix the pile loops. Further, for example, according to Japanese Patent Application Laid-Open No. 2000-41712, the back yarns, middle yarns and front yarns are employed in the same way as the above patent publication and each required number of those yarns are loosened to obtain a tricot knitted fabric having ventilation holes according to Atlas knitting. Thereafter, the front yarns are erected to form pile loops and then the pile loops are fixed to foundation yarns by resin coating or fusion of part of the foundation yarns, thereby producing a knitted surface fastener having ventilation property.

However, because these knitted surface fasteners have a low porosity, the ventilation property is low and further, the rigidity of the surface fastener is not improved because its back face should be coated with resin. As for this point, according to Japanese Utility Model Registration No. 2563369, the chain knitting yarns which are foundation yarns to be knitted in a wale direction and the pile knitting yarns in the pile knitting structure or tricot knitting structure are entangled with the stitches of the chain knitting yarns while forming pile loops. Then, in-laid yarns in a marquisette structure which run in the wale direction and a course direction are entangled between predetermined wales so as to form a net-like foundation fabric having grid-like large gaps. Consequently, the configuration is more stabilized than in case of weaving. Additionally, not only the ventilation is merely improved but also an opposite side can be seen through the foundation fabric, so that this surface fastener matches well when it is mounted on clothes or bag having, in particular, the net structure or lace structure.

On the other hand, according to the above-mentioned U.S. Pat. No. 5,125,246, the pile knitting yarns are entangled with two chain stitches formed on adjoining two courses on the same wale in the form of a closed loop, and then entangled with the chain stitch on an adjoining wale in the form of an open loop, so that the formed pile loop strides obliquely between the adjoining wales and courses. If a tension force is applied to this pile loop with only the above structure, the pile loop is pulled out from the chain stitch with which it is entangled, because an end of the same pile loop is entangled in the form of an open loop, thereby not maintaining a stable loop configuration, so that the separation force of the surface fastener is seriously affected. To avoid this, resin coating is indispensable and thus, the function as the elastomer foundation fabric is not exerted sufficiently and rigidity of the fabric is unavoidable.

As for the knitted surface fasteners disclosed in the above-described Japanese Utility Model Application Laid-Open No. 63-91009 and Japanese Patent Application Laid-Open No. 2000-41712, the back yarns, the middle yarns and the front yarns are employed as described previously. The pile loops are not formed at the same when the front yarns of these three kinds of yarns are knitted in, and instead, after knitting, the front yarns are erected to form the pile loops. Thus, the quantity of production steps increases, and moreover, it is difficult to form the loops securely. Even if the female engaging elements can be formed, it is difficult to form the male engaging elements by cutting out part of the formed loops. Further, because the rear face of the surface fastener after the front yarns are erected is fixed to the foundation fabric with resin coating or fusion of the melting yarns, rigidity of the pile loops is unavoidable.

On the other hand, according to the above-mentioned Japanese Utility Model Registration No. 2563369, although the foundation fabric of the surface fastener is a stabilized net-like fabric having clearly square gaps, the pile knitting yarn strides obliquely on the same course or between adjoining wales and courses and is entangled with the stitches of the chain knitting yarns constituting the wale only in the form of an open loop. Accordingly, the loops are likely to loosen, and therefore, stabilization of the loop configuration is more difficult than in case of the U.S. Pat. No. 5,125,246. Consequently, this Japanese Utility Model Registration No. 2563369 also absolutely requires resin coating on the rear face of the foundation fabric.

Accordingly, the present invention has been accomplished to solve the deficiencies of the respective knitted surface fasteners. A primary object of the invention is to eliminate the necessity of resin coating or fusion of yarns to fix the base of the pile loops on the foundation and a further object of the invention is to provide a knitted surface fastener in which, if it is intended to obtain ventilation property, clearly square gaps are formed to achieve not only the ventilation property but also transparency property.

DISCLOSURE OF THE INVENTION

In a foundation structure as a foundation fabric of an ordinary knitted surface fastener, one or more kinds of warp knitting yarns such as tricot knitting yarn and two-needle-stitch knitting yarn, and a weft in-laid yarn which is inserted into stitches between a predetermined number of wales, folded back and runs in a course direction, are often used with making chain knitting yarns constituting the wale basic, and are knitted together at a high density. At this time, the pile knitting yarns form pile loops which stride between different wales and courses according to the tricot knitting structure as described in the above-mentioned U.S. Pat. No. 5,125,246 or according to the Atlas knitting structure as described in the Japanese Patent Application Laid-Open No. 2000-41712. On the other hand, in the net-like knitted surface fastener in which square gaps are expressed clearly, as disclosed in the Japanese Utility Model Registration No. 2563369, the foundation fabric as a foundation structure is knitted with the chain knitting yarns and marquisette knitting yarns and at the same time, the pile loops are formed with the pile knitting yarns according to the tricot knitting structure or a special knitting structure.

However, the configuration of the pile loop cannot be fixed at an entangling portion of the pile knitting yarn with respect to the foundation yarn in each of these knitted surface fasteners, so that the loop is likely to loosen. Therefore, it is necessary to fix the entangling portion of the foundation yarn and the pile knitting yarn by coating a face of the foundation fabric opposite to a face of the foundation fabric on which engaging elements are formed with resin or by using thermally fusible fibers as part of the knitting yarns which constitute the foundation structure and then fusing these fibers. Although the entangling portion of the foundation yarn and the pile knitting yarn is fixed by such a treatment, the configuration of the pile loops is stabilized thereby the deficiency of loop looseness being eliminated, plasticity and taste particular to such a knitted fabric are often lost for the reason of the adhesion resin.

The present invention has been accomplished to eliminate such a deficiency and the inventors of the present invention made diversified tests in order to develop the knitted surface fastener which needs no special treatment such as coating with resin and fusion of fibers and suffers from no deficiency such as loop looseness. As a result, it has been found that if the knitting structure of the pile knitting yarn which constitutes the pile loops is devised, the deficiency of loop looseness is eliminated without any special treatment after knitting.

The present invention has been achieved based on these finding and the above-mentioned primary object is achieved with a knitted surface fastener in which pile loops, which turn to surface fastener engaging portions, are formed with pile knitting yarns and foundation yarns knitted together, characterized in that, after striding between two or more wales so as to form the pile loops, the pile knitting yarns are entangled continuously with respective stitches of the foundation yarns of three or more adjoining courses on a wale so as to form stitches, and that, of the stitches of the pile knitting yarns formed due to the pile knitting yarns entangled per each of the three or more adjoining courses, at least one stitch located in a middle is formed in a closed loop.

The pile knitting yarn strides between two or more wales and is entangled with the stitch of a foundation yarn existing on the same course or adjoining courses, thereby forming a loop therebetween. The first stitch of the pile knitting yarn formed at a formation end of this loop is not always specified to be in a closed loop or open loop. However, it is important that, of the stitches formed on adjoining three or more courses on the same wale in which this first stitch is formed, at least one or more stitches located in the middle are formed in a closed loop. The configuration of the pile loop becomes unstable depending on the formation position of this closed loop. On the other hand, although it is better as the quantity of these closed loops is increased, because usually the stitches of the pile knitting yarn formed continuously on the same wale are preferred to be three to eight, the closed loops existing in the middle position are disposed such that one to four of them are arranged continuously or discontinuously. However, the stitch in the course direction adjacent the stitch at the formation end of a pile loop, which is constituted of a pile knitting yarn, is desired to be in a closed loop, so that the pile loop is free of being stretched when it is pulled strongly and adjoining other pile loops of the same pile knitting yarn are not affected.

If the stitch located at the middle position of three or more stitches of the same pile knitting yarn, the stitches adjoining in the course direction, is formed in a closed loop, even if a strong tension force is applied to the pile loop formed of the same pile knitting yarn, the stitch is tightened at the closed loop and not moved further. Thus, even if the root of the pile loop and the foundation yarn are not fixed with each other due to resin coating or fusion of fibers, the configuration of the pile loop is not affected and an engaging force with a mating engaging element can be maintained long. Further, to prevent a looseness of the pile loop formed of the pile knitting yarn securely, all stitches of the pile knitting yarn formed by entangling with the stitches of the foundation yarn on adjoining three or more courses on the same wale are desired to be in a closed loop. Such a configuration is permitted if the foundation fabric knitted with foundation yarns is a usual high density knitted fabric as mentioned in the U.S. Pat. No. 5,125,246 or a net-like knitted fabric having large square gaps as described in the Japanese Utility Model Registration No. 2563369.

However, it is preferable that the knitted surface fastener having a typical structure of the net-like foundation fabric is so constructed that the foundation yarns are comprised of the chain knitting yarn forming each wale, and an in-laid yarn which runs in a zigzag pattern while entangled with each stitch of the chain knitting yarn on adjoining two or more wales and courses so as to form a weft yarn every at least three courses; a net having a square gap is formed with the chain knitting yarn and in-laid yarn; the pile knitting yarn forms a stitch at the same entangling position as the in-laid yarn; and pile loops formed between the wales by the pile knitting yarn are formed along the in-laid yarn.

With such a structure, a knitting yarn extending in the wale direction and a knitting yarn extending in the course direction intersect each other at each predetermined interval so as to form large square gaps in a matrix shape. On this net-like foundation fabric, the pile loops striding between two or more wales exist along the knitting yarn extending in the course direction. For the reason, there exists no excessive knitting yarn in the aforementioned gaps, so that not only the transparency is intensified, but also, of three or more stitches in which each pile loop and foundation yarn are entangled with a stitch of the chain knitting yarn in the wale direction, one or more stitches located in the middle are formed in a closed loop, so that so-called loop looseness is eliminated and additionally, plasticity particular to a knitted fabric is secured.

Further, preferably, the in-laid yarns are each comprised of a pair of knitting yarns having an opposite structure with respect to the course direction and are entangled with each other every stitches of adjoining courses on the same wale, so that they run in a zigzag pattern in the course direction while intersecting between the entangled stitches. With such a structure, the above-described function is Improved.

According to the present invention, the pile knitting yarn may be composed of a multi-filament yarn substantially free of twisting. In this case, the female engaging element is formed of the pile loop, and further, the pile knitting yarn can be composed of mono-filament. In this case, the pile loop can be used as the female engaging element as it is or it can be used as a hook-like male engaging element by cutting out part of the same pile loop. To produce the male engaging element, a thick mono-filament yarn is used as the pile knitting yarn.

Further, if a transparent filament yarn is used for at least the pile knitting yarn, the existence of the pile loops becomes inoffensive and a high transparency is achieved in the surface fastener itself. In this case, it is permissible to employ transparent yarns for all knitting yarns which constitute the foundation structure. In this case, transparency of the entire surface fastener is secured, so that various kinds of pictures or multi-colored patterns formed on a surface of clothes on which the surface fastener is attached can be seen through clearly.

DESCRIPTION OF THE PREFERRED EMBODIMENTS

Figure 1:
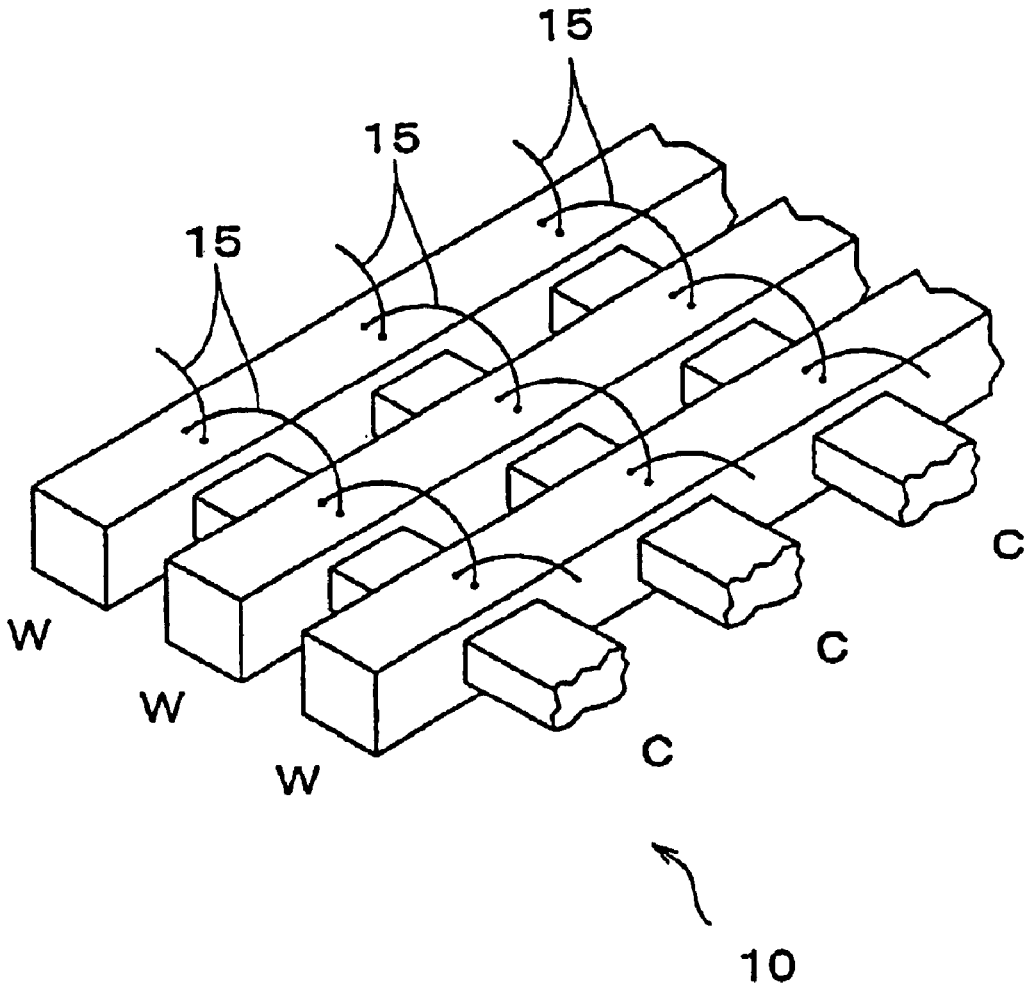
FIG. 1 is a perspective view schematically showing an example of a knitted surface fastener of the present invention having a knitted foundation fabric.
Figure 2:
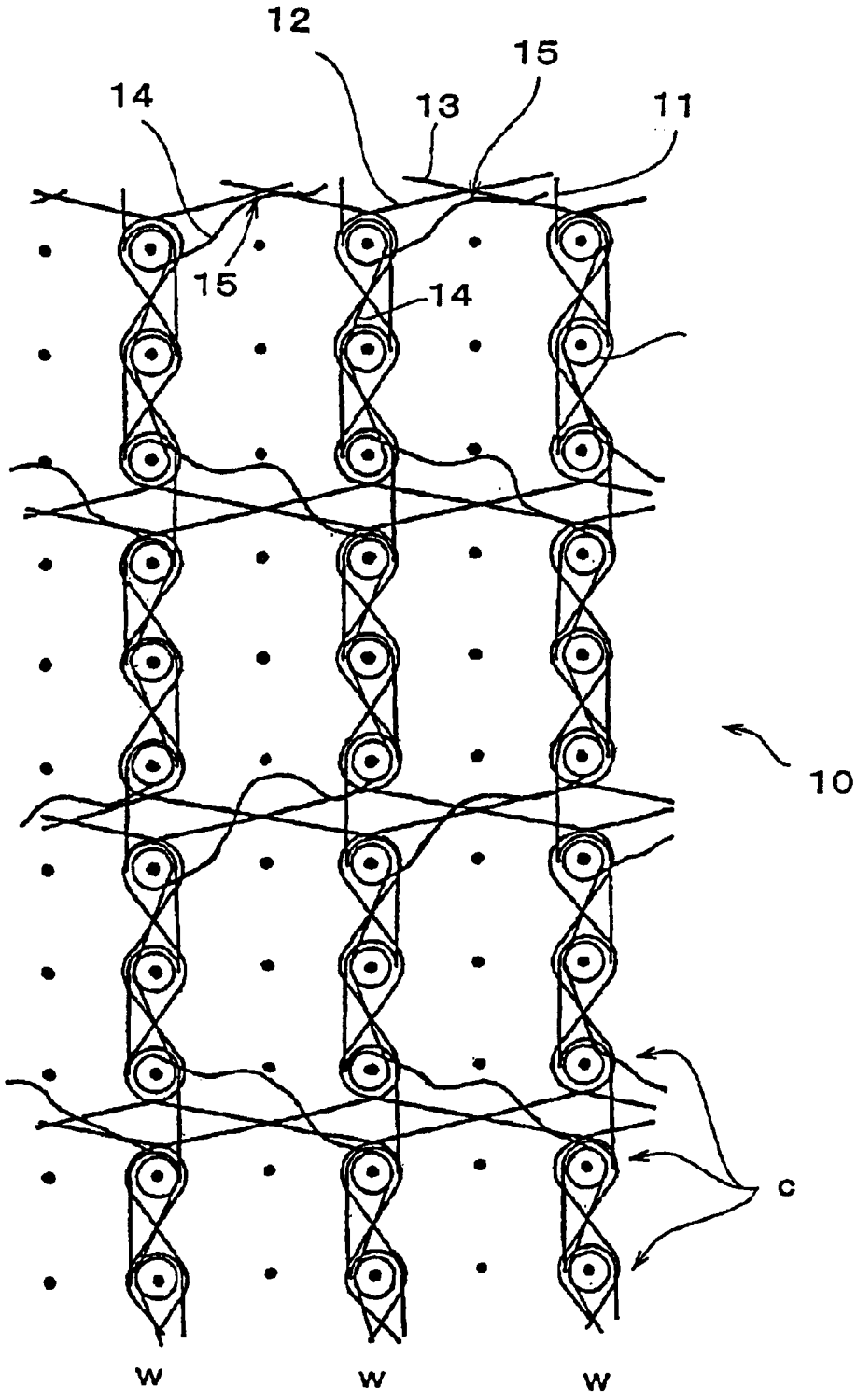
FIG. 2 is a diagram of an entire knitting structure of the knitted surface fastener according to a typical embodiment of the present invention.
Figure 3:
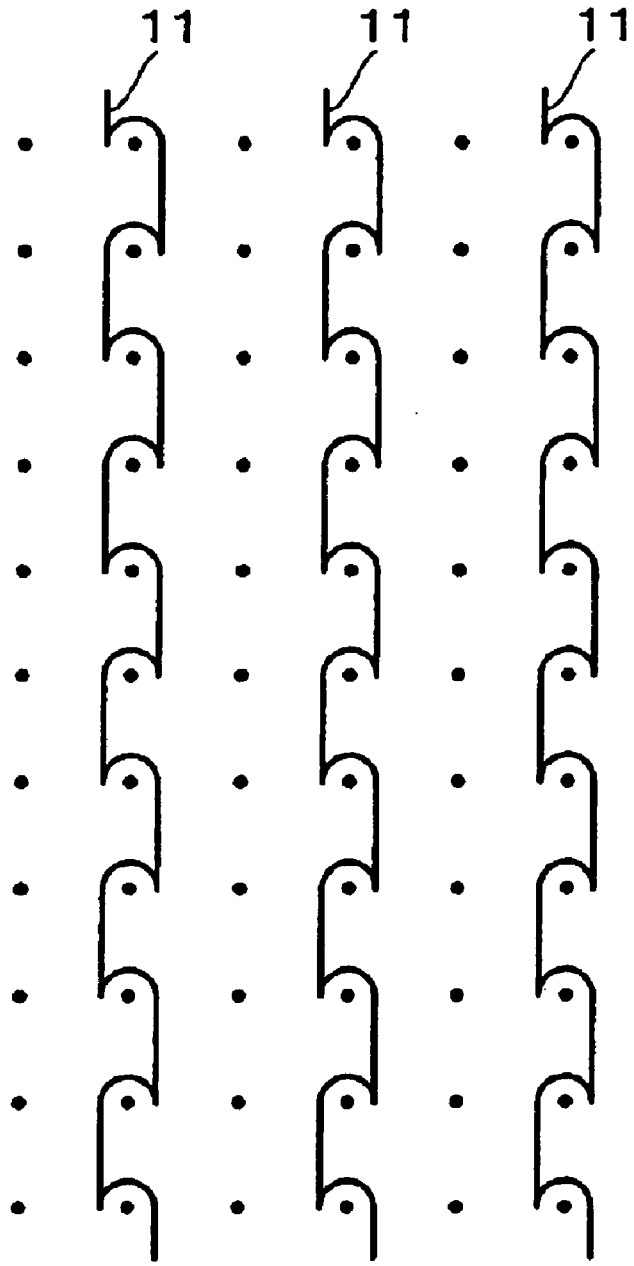
FIG. 3 is a knitting structure diagram of chain knitting yarns for forming wales of the surface fastener.
Figure 4:
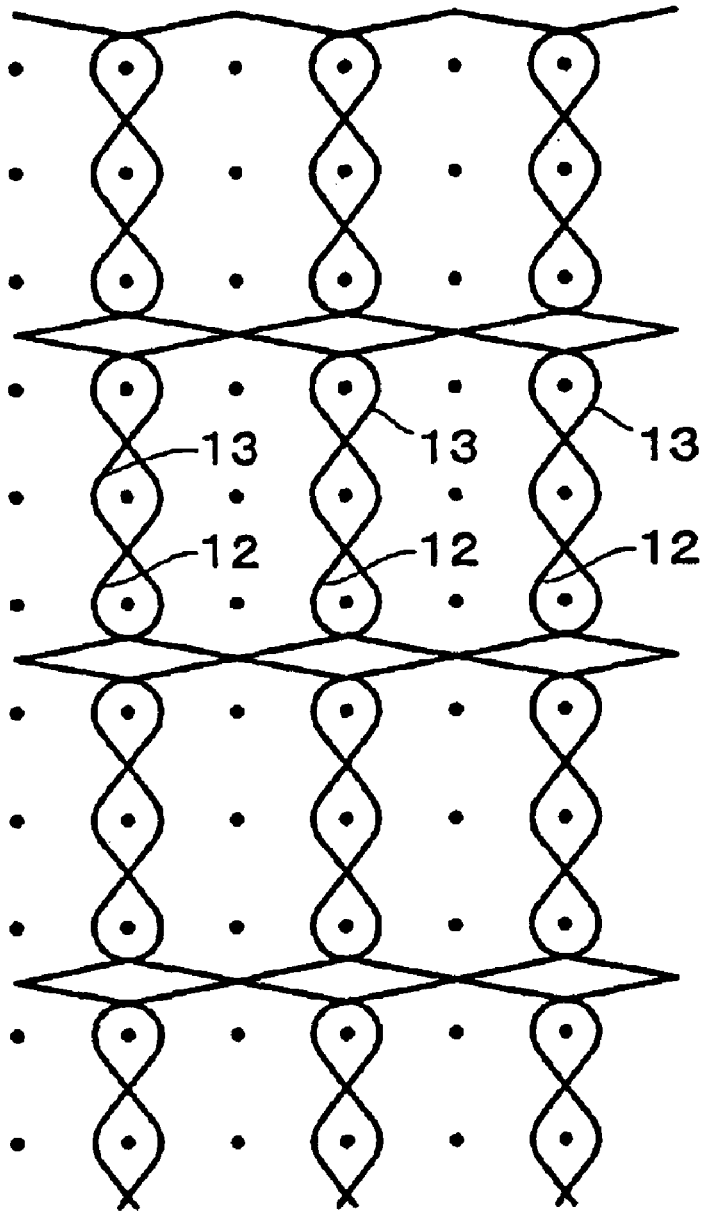
FIG. 4 is a knitting structure diagram of in-laid yarns which are part of composition yarns of a net-like foundation fabric of the surface fastener.
Figure 5:
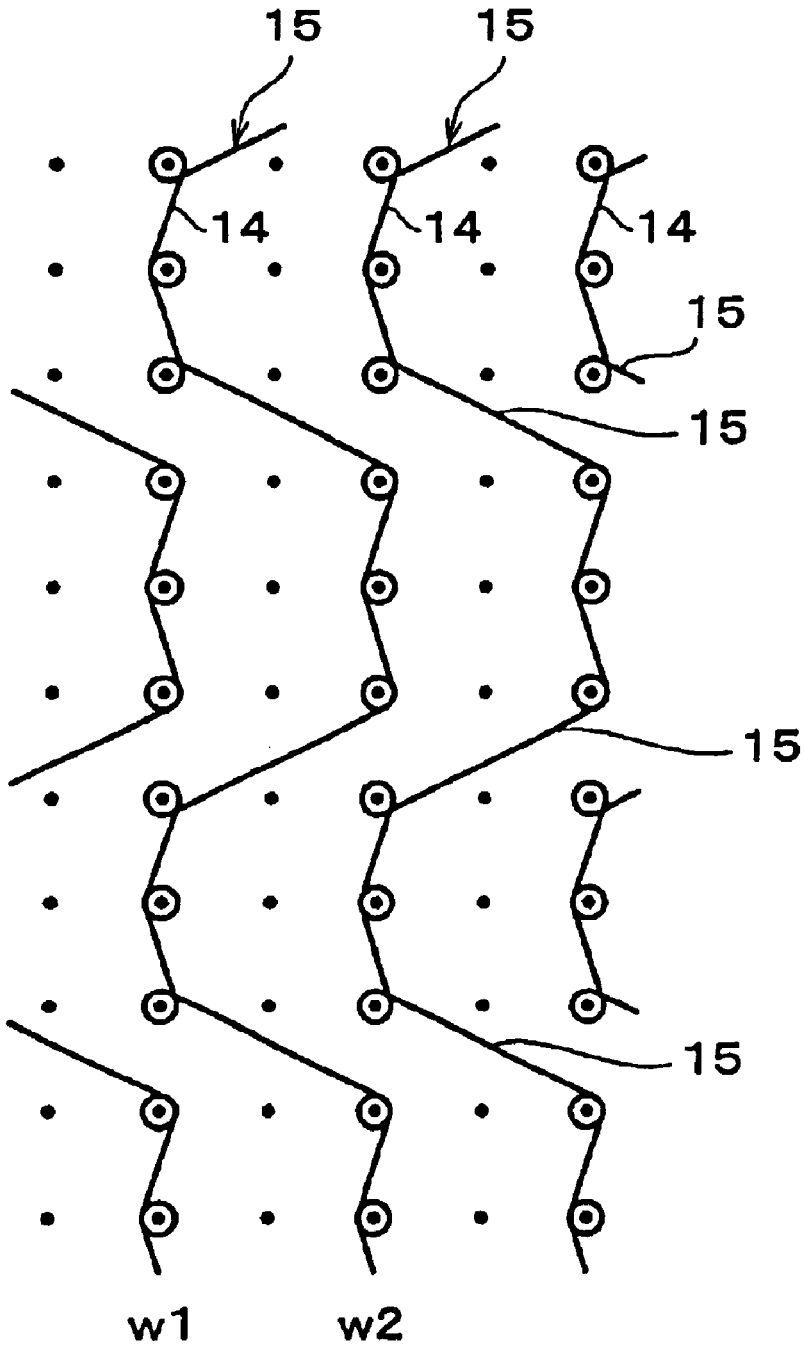
FIG. 5 is a knitting structure diagram of pile knitting yarns for forming pile loops of the surface fastener.

Hereinafter, the preferred embodiments of the present invention will be described in detail with reference to the accompanying drawings. FIG. 1 shows schematically an appearance of the knitted surface fastener of the present invention. FIG. 2 shows its entire knitting structure. FIGS. 3 to 5 show the knitting structure of each composition yarn in the knitted surface fastener of this embodiment.

The knitted surface fastener 10 of this embodiment is constituted of chain knitting yarns 11 having a repetitive knitting structure of 0-1/1-0 shown in FIG. 3, first in-laid yarns 12 having a repetitive knitting structure of 0-0/1-1/0-0/3-3/2-2/3-3 shown in FIG. 4, second in-laid yarns 13 having a repetitive knitting structure of 3-3/2-2/3-3/0-0/1-1/0-0 shown in FIG. 4, and pile knitting yarns 14 having a repetitive knitting structure of 0-1/1-0/0-1/2-3/3-2/2-3, totaling four kinds of knitting yarns. According to this embodiment, all the knitting yarns are jumped at every needle in a course C direction (right and left direction in each drawing) so as to form a wale W.

The chain knitting yarn 11 forms stitches continuously with open loops in a wale W direction. The first in-laid yarn 12 is entangled with three stitches of the chain knitting yarn 11 located on the same wale W in a zigzag manner, and then is entangled with a stitch of the chain knitting yarn 11 located on an adjoining course C of an adjoining wale. Thereafter, this in-laid yarn is entangled with three stitches of the chain knitting yarn 11 formed on the same wale W in a zigzag manner, and then is entangled with a stitch of the chain knitting yarn 11 formed on an adjoining course C of the original wale W, and this entangling is repeated in a zigzag manner three times in the wale W direction. By such repeating, this in-laid yarn runs largely in a zigzag manner between the two wales. On the other hand, the second in-laid yarn 13 is entangled with the stitches of the same chain knitting yarn 11 with which the first in-laid yarn 12 is entangled three times continuously, and then moves to a wale W adjoining opposite to the wale W to which the first in-laid yarn 12 moves. Thereafter, the second in-laid yarn is entangled with three stitches on the same wale W in a zigzag manner. That is, the first in-laid yarn 12 and the second in-laid yarn 13 have a knitting structure symmetrical across the wale W located in the middle of the three wales W. This is an opposite structure.

In this way, a foundation fabric of the net-like surface fastener 10, in which large square gaps are disposed in a matrix shape as shown schematically in FIG. 1, is formed with the chain knitting yarns 11, the first in-laid yarns 12 and the second in-laid yarns 13. That is, the chain knitting yarns 11 form the wales W continuously and then, part of the wales W are formed by the entangling portions of the first and second in-laid yarns 12, 13. After the first and second in-laid yarns 12, 13 move to the adjoining wales W, they jump by single needle in the course C direction and are entangled with the three stitches in the wale W direction while combining the adjoining wales W with each other, so that finally, a net-like foundation fabric in which square gaps are so to say formed with warp yarns and weft yarns is formed by knitting.

The aforementioned pile knitting yarn 14 forms all stitches with close loops as shown in FIG. 5. This pile knitting yarn 14 is knitted into the foundation fabric under the above-described knitting structure, and when moving to an adjoining wale W1, this pile knitting yarn forms a pile loop 15. That is, the pile knitting yarn 14 forms a stitch itself while entangled with the stitch of the chain knitting yarn 11 on the first wale W1 and next, while entangled with the stitches of the chain knitting yarn 11 on the adjoining two courses C on the same wale W1, forms two stitches successively itself, so that three stitches are formed continuously on the same wale W1. Thereafter, the pile knitting yarn 14 moves to the adjoining second wale W2 and while entangled with three continuous stitches of the chain knitting yarn 11 successively on adjoining three courses C, forms three stitches continuously Itself as described above. Then, the same pile knitting yarn 14 returns to the original first wale W1 and in subsequent process, knitted successively into the foundation fabric through the same operation. According to this embodiment, as described above, the pile knitting yarn 14 strides between the adjoining wales W and at the same time, it forms the pile loop 15. In addition, all stitches of the same pile knitting yarn 14 formed by entangled with the stitches of the chain knitting yarn 11 are formed into a closed loop.

The formation position of the stitch of the pile knitting yarn 14 is equal to the entangling position of the first in-laid yarn 12 inserted into the stitch of the chain knitting yarn 1 in an entangling condition, as shown in FIG. 2. Therefore, the formation position of the pile loop 15 is equal to the running position where the first in-laid yarn 12 runs between the adjoining wales W. This means that the pile loop 15 formed of the same pile knitting yarn 14 is formed along the weft yarn portion of the foundation fabric formed in a matrix form as shown in FIG. 1.

The first characteristic feature of the knitted surface fastener 10 according to this embodiment is that all the stitches of the pile knitting yarns 14 which form the pile loops 15 are formed in a closed loop, respectively. If they are formed in such a closed loop, for example, if a tension force is applied to the pile loop 15, a tightening force is applied to the pile knitting yarn 14 at stitches because the stitches formed on both ends of the pile loop 15 are formed in the closed loop, so that the stitch of the chain knitting yarn 1 and the entangling portion of the first and second in-laid yarns 12, 13 are tightened, thereby eliminating such a fear that the pile loop 15 is pulled out inversely through the stitches. In short, the knitted surface fastener 10 of this embodiment prevents the pile loop 15 from being pulled out even if no resin coating or no fusion with thermally fusible fibers or the like is conducted on the rear face thereof. Of course, this embodiment does not exclude the resin coating or fusion with thermally fusible fibers.

Because the knitted surface fastener 10 of this embodiment, as shown in FIGS. 1 and 2, has a net-woven-fabric-like appearance in which large gaps are disposed entirely in the matrix shape, not only surface patterns of clothes, a bag, or the like existing on opposite side to the formation face of the pile loops can be seen through those gaps, but also if the clothes or bag as an attachment object is made in the form of a net or lace having many gaps, this knitted surface fastener matches well and never lose ventilation property of the clothes or bag. Further, because the pile loops formed on a surface of the net-like foundation fabric runs along the weft yarn portions of the same foundation fabric, the ventilation property and transparency thereof are never deteriorated and the existence of the pile loops is not offensive, thereby providing an excellent appearance in terms of design.

In the meantime, the knitted surface fastener of the present invention does not limit the material of its composition yarns to any particular one. However, if synthetic resin filaments having a high transparency are used at least for the pile knitting yarns, the existence of the pile loops becomes inoffensive. Alternatively, if the synthetic resin filaments having a high transparency are used for all composition yarns, the entire surface of the attachment object on the rear side thereof can be seen through the surface fastener, thereby existence of the surface fastener being not offensive. Further, according to this embodiment also, part of the composition yarns of the knitted surface fastener 10 can be decorated in the same or a different color. In this case, a colored pattern can be expressed in the surface fastener itself, thereby providing a beautiful appearance. Moreover, the pattern of the surface fastener can be matched with the surface pattern of the attachment object depending on the case.

Figure 6A:
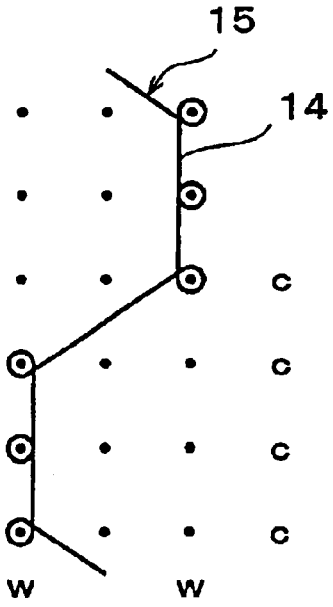
FIGS. 6A to 6D are knitting structure diagrams, each showing a modification of the knitting structure diagram of the pile knitting yarns.

FIGS. 6A to 6D show examples of diversified knitting structures by the pile knitting yarns 14 used in the knitted surface fastener 10 according to the present invention. FIG. 6A shows the knitting structure adopted in the above-described embodiment and is the same as the knitting structure shown in FIG. 5. In examples shown in FIGS. 6B and 6D, one of the stitches formed on both ends of the pile loop 15 formed between two wales W in the repetitive structure of the pile knitting yarn 14 is formed in an open loop while all the other stitches are formed in the closed loop. In an example shown in FIG. 6C, the stitches formed on both ends of the pile loop 15 formed between two wales W in the repetitive structure of the pile knitting yarn 14 are formed in the open loop while only a stitch located in the middle of the three continuous stitches formed on the same wale W is formed in the closed loop. Of course, it is permissible to form the stitch of an end of the pile knitting yarn 14 in the open loop while forming the other stitches in the closed loop.

Figure 6B:
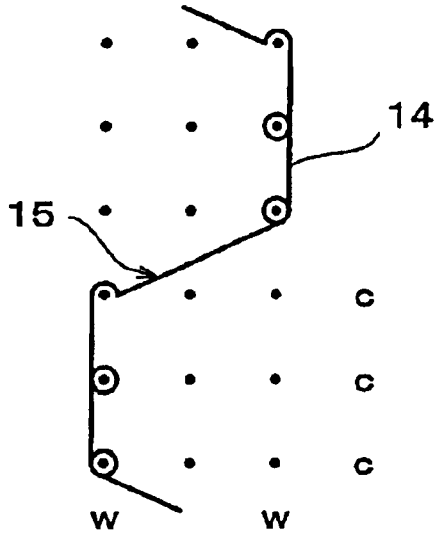
Figure 6C:
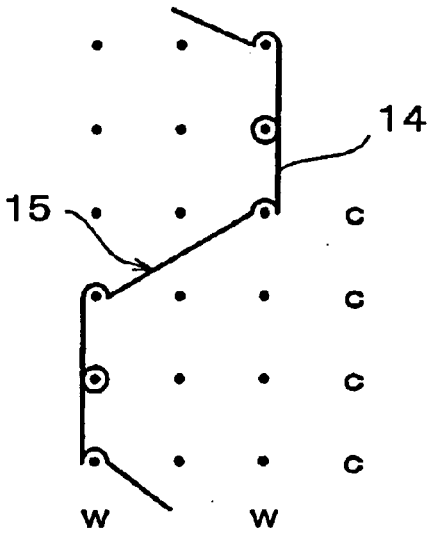
Figure 6D:
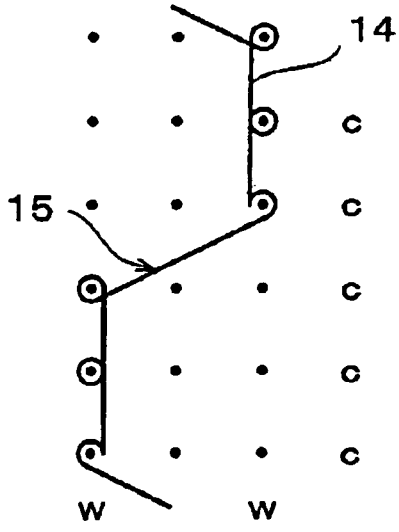

According to the present invention, all the stitches formed by the aforementioned pile knitting yarn 14 do not have to be formed in the closed loop as shown in FIG. 6A and if at least the stitch located in the middle of three or more stitches formed continuously on the same wale W is formed in the closed loop as shown in FIGS. 6B to 6D, looseness of the pile loop can be prevented effectively even if the root of the loop is not fixed on the foundation yarn by fusion or the like.

Figure 7:
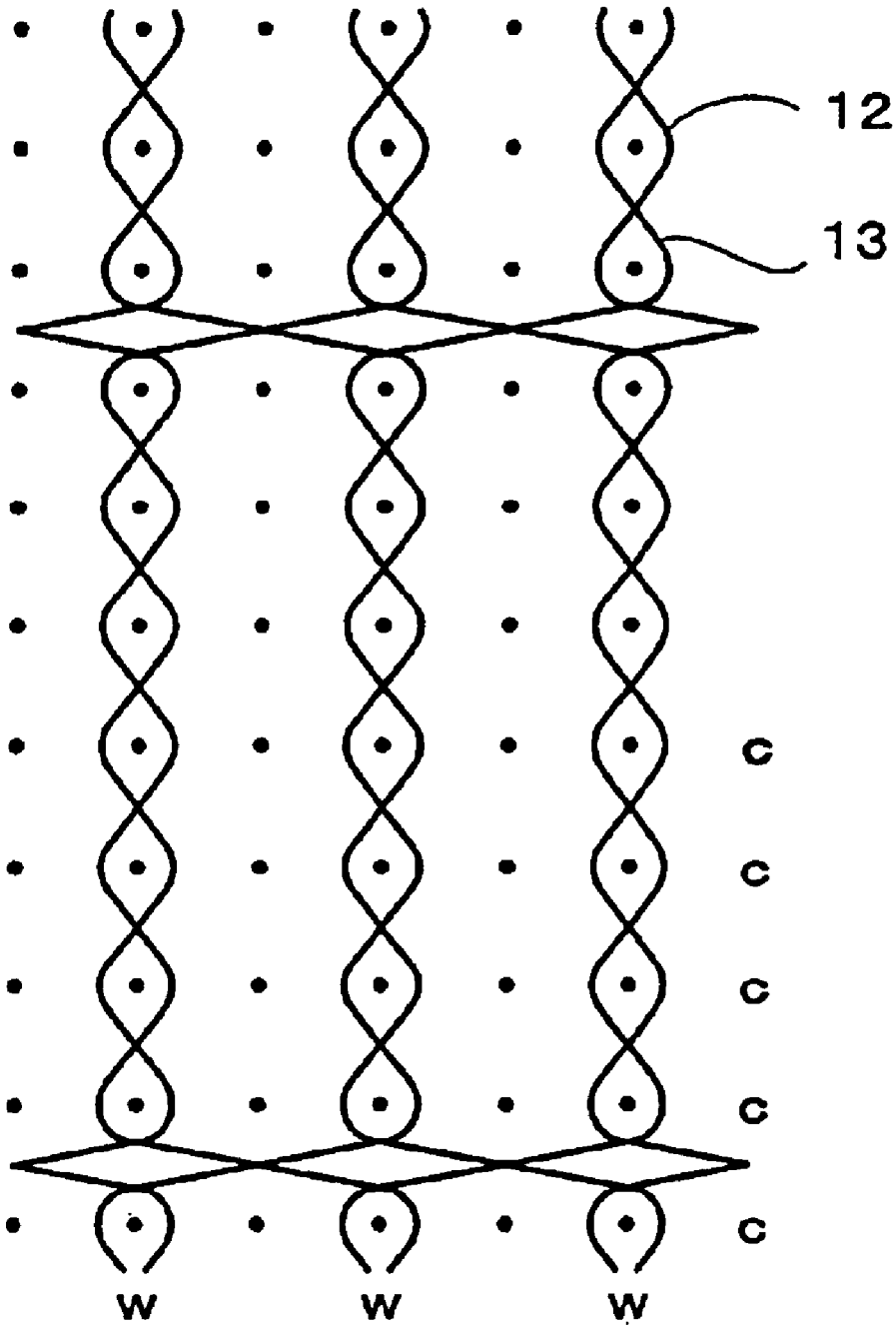
FIG. 7 is a knitting structure diagram showing a modification of the knitting structure of the in-laid yarns.
Figure 8:
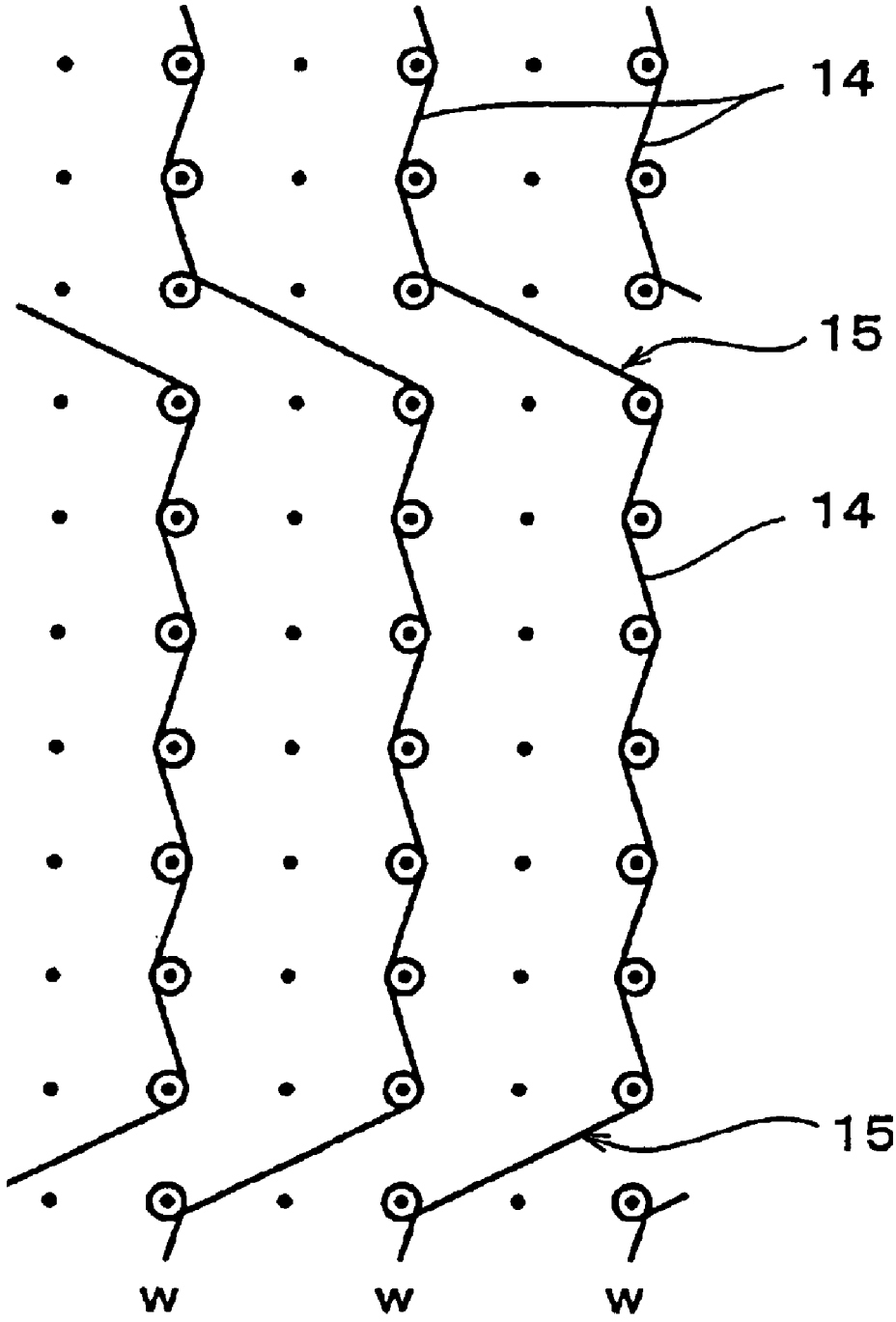
FIG. 8 is a structure diagram of pile knitting yarns knitted in together with the in-laid yarns.

FIGS. 7 and 8 show other modifications of the above-described embodiment. FIG. 7 shows a modified knitting structure of the first and second in-laid yarns 12, 13 and FIG. 8 shows a modified knitting structure of the pile knitting yarns 14. The chain knitting yarn 11 is not changed in both cases. According to this embodiment, the quantity of entangling of the first and second in-laid yarns 12, 13, which are entangled with the chain stitches on the same wale W in a zigzag manner, is 7, and further, the number of the stitches of the pile knitting yarns 14 formed continuously at the entangling positions of the first and second in-laid yarns 12, 13 on the same wale W is also 7. Even if the structure of the first and second in-laid yarns 12, 13 and the pile knitting yarns 14 is changed like this, the structure is substantially the same as the above-described embodiment shown in FIGS. 2 to 5 except that its gaps are enlarged and the achieved operation and effect are not different except that the ventilation property and transparency are improved. That is, it is understood that the size of the gap and ventilation property in the net-like foundation fabric can be changed easily by changing the number of the stitches formed continuously on the same wale W.

Figure 9:
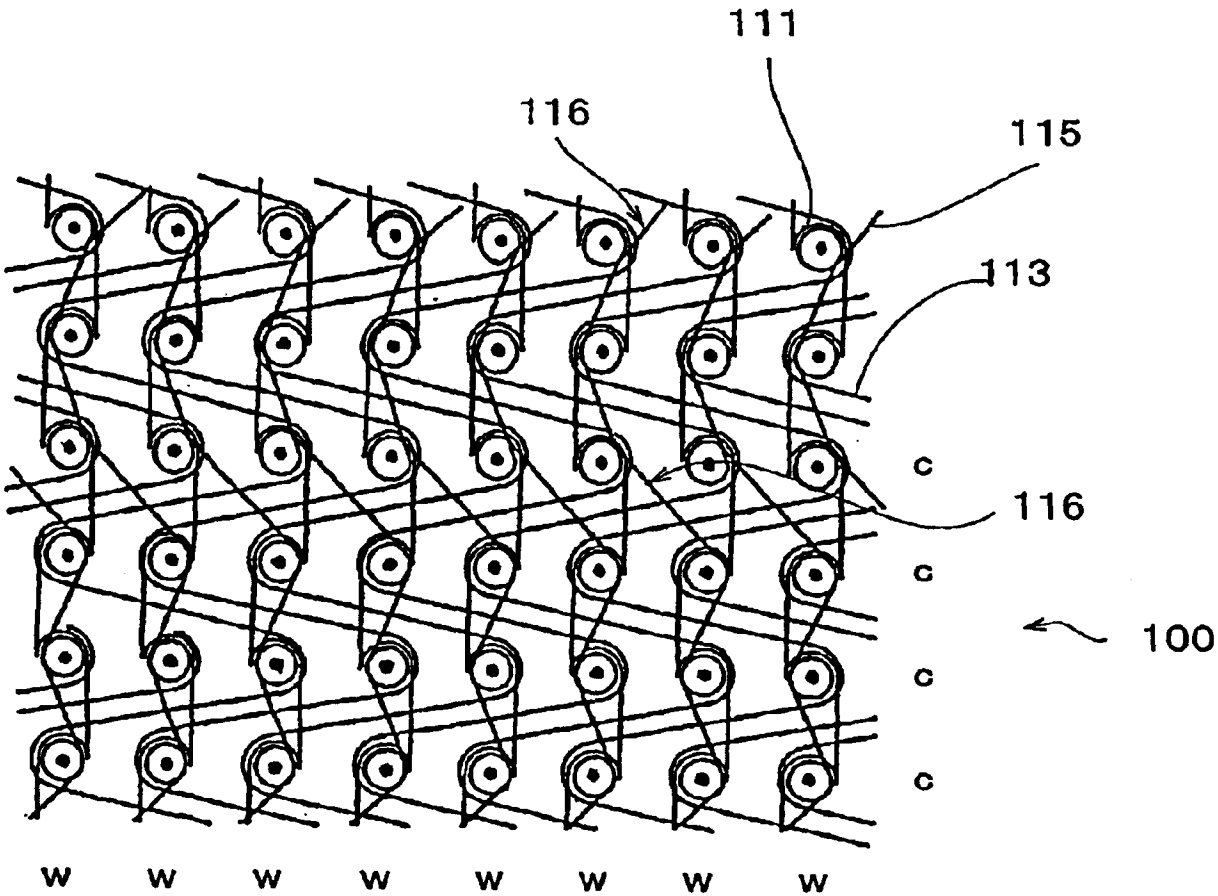
FIG. 9 is a partial knitting structure diagram of the surface fastener of the present invention having an ordinary high-density foundation fabric.
Figure 10:
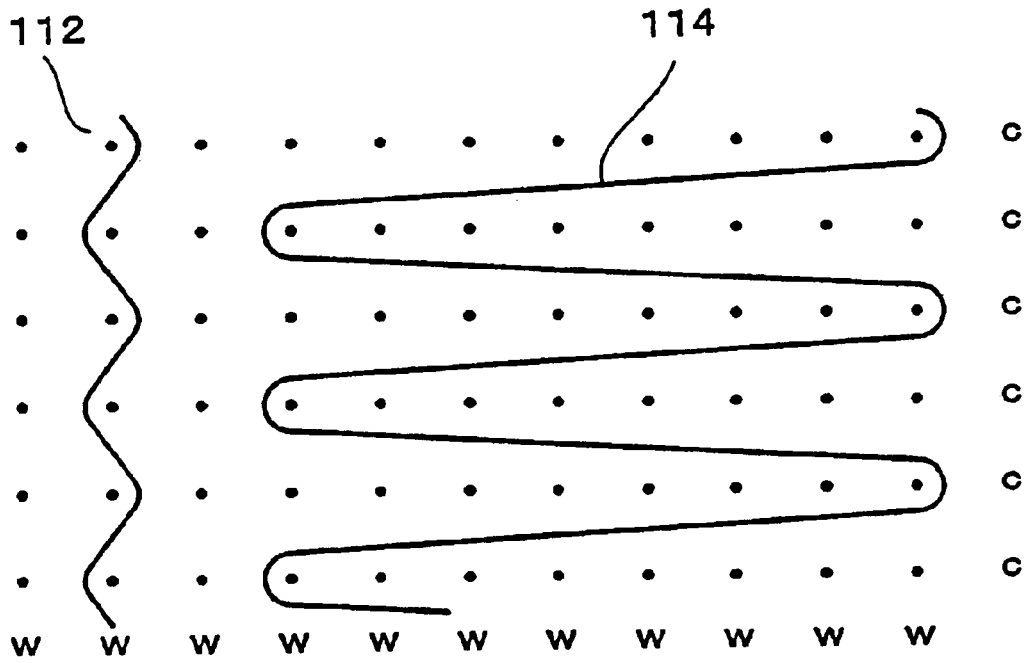
FIG. 10 is a knitting structure diagram of remaining knitting yarns of the surface fastener.

FIGS. 9 and 10 show another embodiment of the present invention. A knitted surface fastener 100 of this embodiment is a high density knitted surface fastener, in which its foundation fabric is not formed in to a net-like formation unlike the above-described embodiment but the same pile knitting yarns 115 as the above-described embodiment is knitted into an ordinary warp knitting structure. Because the surface fastener 100 of this embodiment is constituted of many kinds of composition yarns, if all those knitting yarns are expressed on the same drawing, they are very difficult to see, and therefore, they are expressed separately in FIGS. 9 and 10.

The foundation yarns constituting the foundation fabric of the knitted surface fastener 100 of this embodiment are comprised of four kinds of yarns, namely, a chain knitting yarn 111 (FIG. 9) which is the same as the previously described embodiment, a warp in-laid yarns 112 (FIG. 10) which runs in a zigzag manner through the stitches of the chain knitting yarn 111 on the same wale W, a first weft in-laid yarn 113 (FIG. 9) having a knitting structure of 0-0/3-3 folded back among three wales W while entangled with the stitches of the chain knitting yarn 111, and a second weft in-laid yarn 114 (FIG. 10) having a knitting structure of 0-0/8-8 folded back among eight wales while running in the same direction as the first weft in-laid yarn 113. On the other hand, the knitting structure of a pile knitting yarn 115 which is knitted into the foundation fabric to form pile loops 116 has a knitting structure in which 0-1/1-0/0-1/1-2/2-1/1-2 is a repetitive unit.

Although the foundation fabric of this embodiment is different from the previously described embodiment, the stitch of the pile knitting yarn 115 is formed in the closed loop at the stitch of the chain knitting yarn 111 and at each folding back portion of the warp in-laid yarn 112 and the first and second weft in-laid yarns 113, 114, the chain knitting yarn 111, the warp in-laid yarn 112 and the first and second weft in-laid yarns 113, 114 being foundation yarns, because the pile knitting yarn 115 has the same knitting structure as the previously described embodiment. Consequently, even if a tension force is applied to, for example, the pile loops 116, they tighten each other across the entangling portions with respect to the foundation yarn, so that the pile knitting yarn 115 is not moved in a direction of a length of the yarn, thereby not changing the loop shape. For the reason, it is not necessary to coat the rear face opposite to the pile loop formation face of the foundation fabric with synthetic resin or mix fibers having a low melting point in part of the foundation yarns to be fused together.

The pile knitting yarns 14, 115, which constitute the pile loops 15, 116 in the knitted surface fasteners 10, 100 of the present invention, the fasteners knitted in the above-described matter, are composed of synthetic resin multi-filament or mono-filament. The multi-filament is an aggregate of fine filaments and substantially free of twisting. The pile loops formed of this multi-filament are raveled apart in units of respective filaments by buffing or the like, so that they are directed in multi-directions, thereby turning to female engaging elements which engage with or disengage from the male engaging elements compose of, for example, mating hook pieces.

If the mono-filaments having a high fineness are used for the pile knitting yarns 14, 115, the formed pile loops 15, 116 can be used as the female engaging elements without any special treatment. If the pile knitting yarns 14, 115 are of mono-filaments having a low fineness, part of the formed pile loops 15, 116 are cut out into hook-shaped male engaging elements. Such male engaging elements have a fear that, because part of the pile loops 15, 116 are cut out, the loops may loosen in case of a simple pile knitting structure as described above or if the loops are only formed with the closed loop. In this case, it is permissible to coat the same loops with a slight amount of resin or mix a small number of fibers having a low melting point and fuse together. Even if such resin coating is carried out, the consumption of resin can be reduced largely because looseness of the loops is suppressed by the pile knitting structure of the present invention, and therefore, the foundation fabric can be prevented from becoming too rigid.

What is claimed is:

1. A knitted surface fastener in which pile loops, which turn to surface fastener engaging portions, are formed with pile knitting yarns and foundation yarns knitted together, wherein, after striding between two or more wales so as to form the pile loops, the pile knitting yarns are entangled continuously with respective stitches of the foundation yarns of three or more adjoining courses on a wale so as to form stitches, and of the stitches of the pile knitting yarns formed due to the pile knitting yarns entangled per each of the three or more adjoining courses, at least one stitch located in a middle is formed in a closed loop.

2. The knitted surface fastener according to claim 1, wherein all stitches of the pile knitting yarns formed due to the pile knitting yarns entangled with the stitches of the foundation yarns on three or more adjoining courses on a same wale are formed in the closed loop.

3. The knitted surface fastener according to claim 1, wherein the foundation yarns are comprised of chain knitting yarns forming respective wales, and in-laid yarns which run in a zigzag pattern while entangled with respective stitches of the chain knitting yarns on adjoining two or more wales and courses so as to form weft yarn portions every at least three courses, a net having square gaps is formed by the chain knitting yarns and the in-laid yarns, the pile knitting yarns form stitches at same entangling positions as those of the in-laid yarns, and pile loops formed between the wales by the pile knitting yarns are formed along the in-laid yarns.

4. The knitted surface fastener according to claim 1, wherein in-laid yarns are comprised of a pair of knitting yarns each having an opposite structure with respect to a course direction and entangled every stitches of adjoining courses on a same wale respectively, so that they run in a zigzag pattern in the course direction while intersecting between the entangled stitches.

5. The knitted surface fastener according to claim 1, wherein the pile knitting yarns are composed of multi-filaments and female engaging elements are constituted of the pile loops.

6. The knitted surface fastener according to claim 1, wherein the pile knitting yarns are composed of mono-filaments and female engaging elements or male engaging elements are constituted of the pile loops.

7. The knitted surface fastener according to claim 1, wherein at least the pile knitting yarns are composed of transparent filament yarns.

* * * * *